US008899860B2

(12) United States Patent
Baines et al.

(10) Patent No.: US 8,899,860 B2
(45) Date of Patent: Dec. 2, 2014

(54) DISPENSER

(75) Inventors: Roger Anthony Baines, Bradford (GB); Martin Christopher Bunce, Pewsey (GB); Geoffrey Stephen Mawtus, Leeds (GB); Alex Sandor Szekely, Jackson, NJ (US); Juraj Ulik, Nottinghamshire (GB)

(73) Assignee: Conopco Inc., Englewood Cliffs, NJ (US)

( * ) Notice: Subject to any disclaimer, the term of this patent is extended or adjusted under 35 U.S.C. 154(b) by 832 days.

(21) Appl. No.: 13/140,027

(22) PCT Filed: Dec. 18, 2009

(86) PCT No.: PCT/EP2009/067505

§ 371 (c)(1),
(2), (4) Date: Nov. 1, 2011

(87) PCT Pub. No.: WO2010/072669

PCT Pub. Date: Jul. 1, 2010

(65) Prior Publication Data

US 2012/0039655 A1 Feb. 16, 2012

(30) Foreign Application Priority Data

Dec. 23, 2008 (EP) ..... 08172815

(51) Int. Cl.
*B43K 5/06* (2006.01)
*A45D 40/04* (2006.01)
*B65D 83/00* (2006.01)

(52) U.S. Cl.
CPC ..... *A45D 40/04* (2013.01); *B65D 83/0011* (2013.01)
USPC ..... 401/175; 401/174

(58) Field of Classification Search
USPC ..... 401/68, 75, 76, 82, 174, 175, 182
See application file for complete search history.

(56) References Cited

U.S. PATENT DOCUMENTS

| | | | |
|---|---|---|---|
| 3,008,172 | A | 12/1958 | Thompson |
| 4,545,696 | A | 10/1985 | Carluccio |
| 4,605,330 | A | 8/1986 | Crowley |
| 4,664,547 | A | 5/1987 | Rosenwinkel |
| 4,915,528 | A | 4/1990 | Seager |

(Continued)

FOREIGN PATENT DOCUMENTS

| | | | |
|---|---|---|---|
| CN | 1409609 | A | 4/2003 |
| CN | 1472122 | A | 2/2004 |

(Continued)

OTHER PUBLICATIONS

PCT International Search Report in PCT application PCT/EP2009/067505.

(Continued)

*Primary Examiner* — David Walczak
(74) *Attorney, Agent, or Firm* — Karen E. Klumas

(57) ABSTRACT

A dispenser for stick material that is suitable for bottom filling comprises a barrel (2) having at one end a base (6) with a central hollow boss with integrally moulded mountings for a separately moulded spindle having at one end at least two opposed struts terminating in means to engage with the mountings in the boss. Preferably, the spindle snaps fits with the boss. Preferably, the spindle has two struts that align with spokes within a skeletal platform (30) that link a filling ring therein to its rim.

13 Claims, 11 Drawing Sheets

(56) References Cited

U.S. PATENT DOCUMENTS

| | | | | |
|---|---|---|---|---|
| 4,950,094 | A | 8/1990 | Yorks | |
| 5,437,513 | A * | 8/1995 | Favre | 401/68 |
| 5,529,416 | A | 6/1996 | Favre | |
| 5,842,802 | A * | 12/1998 | Lang et al. | 401/68 |
| 5,868,510 | A | 2/1999 | Lacout | |
| 6,299,369 | B1 | 10/2001 | Baines | |
| 6,811,062 | B2 | 11/2004 | Tani | |
| 6,960,208 | B2 | 11/2005 | Bourne | |
| 7,389,894 | B2 | 6/2008 | Danne | |
| 8,297,867 | B2 | 10/2012 | Nasu | |
| 2007/0098479 | A1 | 5/2007 | Kim | |
| 2009/0317168 | A1 | 12/2009 | Theroude | |

FOREIGN PATENT DOCUMENTS

| | | | |
|---|---|---|---|
| CN | 1505485 | A | 6/2004 |
| CN | 1893852 | A | 1/2007 |
| DE | 2807472 | | 8/1979 |
| DE | 2807472 | A1 | 8/1979 |
| DE | 19705719 | A | 8/1998 |
| DE | 19705719 | A1 | 8/1998 |
| EP | 0617904 | A1 | 10/1994 |
| EP | 0632978 | A1 | 11/1995 |
| EP | 0650336 | | 1/1997 |
| EP | 0813829 | A1 | 12/1997 |
| FR | 2556941 | | 6/1985 |
| FR | 2573734 | A | 5/1986 |
| JP | 2008206723 | | 9/2008 |
| WO | WO2008018367 | A1 | 2/2008 |
| WO | WO2008029016 | A1 | 3/2008 |

OTHER PUBLICATIONS

PCT International Search Report in PCT application PCT/EP2009/067506.

PCT International Search Report in PCT application PCT/EP2009/067504.

IPRP in PCTEP2009067505, IPRP in PCTEP2009067505 dated Jun. 29, 2011.

IPRP in PCTEP2009067506, IPRP in PCTEP2009067506 dated Dec. 18, 2009.

IPRP2 in PCTEP2009067504, IPRP2 in PCTEP2009067504 dated Jun. 29, 2011.

Search Report in EP08172815, Search Report in EP08172815 dated Jul. 14, 2009.

Search Report in EP08172817, Search Report in EP08172817 dated Jun. 17, 2009.

Search Report in PCTEP2009067504, Search Report in PCTEP2009067504 dated Apr. 28, 2010.

Written Opinion in EP08172815, Written Opinion in EP08172815 dated Jul. 14, 2009.

Written Opinion in PCT/EP2009067504, Written Opinion in PCT/EP2009067504 dated Jun. 29, 2011.

Written Opinion in PCTEP2009067506, Written Opinion in PCTEP2009067506 dated Dec. 18, 2009.

* cited by examiner

DISPENSER

The present invention relates to a dispenser for a cosmetic product, and in particular to a dispenser for a product in stick form.

BACKGROUND AND PRIOR ART

Cosmetic formulations (alternatively called compositions) or like materials can be topically applied to a surface, such as skin, in a variety of different physical forms, using a variety of different dispensers (applicators) of which one combination comprises a stick, made from firm, solid material, by which is meant a solid integral bar that retains its shape if removed from the dispenser. This is to be contrasted with soft solids that do not retain their shape if removed from the dispenser.

A dispenser for sticks conventionally comprises a barrel that is open at one end within which a platform (sometimes alternatively called an elevator, godet or piston) can be advanced towards the open end. Such a dispenser often comprises a mechanism for advancing and commonly, though not always, also for retracting the platform and usually has a cap for the open end to reduce substantially loss of volatile substances from the stick composition.

Herein, although the discussion of dispensers is made explicitly in relation to dispensing cosmetic stick formulations, including in particular antiperspirant and/or deodorant formulations, and is of particular benefit to such cosmetic formulations, it will be recognised that the problems and their solution can apply mutatis mutandis to like materials. Such materials can include, if desired, therapeutic or curative stick formulations, intended for application to humans or animals.

In use, a fraction of the stick is conventionally advanced through the open end of the barrel, i.e. its top and is wiped across the surface to which the composition is to be applied. This imparts a lateral force to the stick which could dislodge the stick from the platform unless it is adhered to the upper face of the platform. Up herein indicates towards the open end and upper closer to the open end, whereas down indicates away from the open end, i.e. towards the bottom (otherwise referred to as base) of the barrel and lower further away from the open end, i.e. closer to the base. The terms top and bottom are employed correspondingly in regard to the other components of the dispenser, such as the platform, the rotor wheel and the spindle, and parts of such components. Herein, outward indicates towards the exterior of the dispenser or of a part of a component when fitted within the dispenser and is usually employed in relation to a lateral part. Inward indicates away from the exterior of the dispenser, commonly laterally.

When stick dispensers were first introduced, they employed a generally solid platform with a central threaded aperture, having a flat or possibly domed upper surface. However, dispensers having a solid platform must be filled from the top, through the open end of the barrel, which runs the risk of spillage if the amount of material discharged into the barrel is not controlled very closely. Moreover, the top surface of the stick material can present a rough appearance that does not appeal to consumers, so that a subsequent processing step is needed to create a smooth and acceptable appearance. Consequently, stick dispensers that are able to be filled through the base of the dispenser have been proposed, sometimes called bottom fill, as in for example U.S. Pat. No. 4,605,330 and other subsequently. In such dispensers, the rotor wheel that is mounted in the base of the barrel defines a central aperture spanned by a cross spoke or spokes bearing the spindle and the platform likewise defines an aperture or apertures through which the stick material can flow. Typically, the barrel is inverted for filling through the base and its open end is closed by a former or temporarily by a puck during the filling operation. The platform can comprise a solid lateral plate having a rim that contacts the barrel sidewall and one or more apertures or may be skeletal. By skeletal in this context is meant a structure that comprises a plurality of upstanding walls, defining apertures in between, though some, but not all, of the skeletal structure may be spanned by a lateral sheet. Typically, a skeletal platform comprises a rim wall, that may be continuous or intermittent, and several designs also comprised a number of radiating spokes from a central hub.

A number of problems have been identified in respect of stick dispensers in general and bottom fill stick dispensers in particular. It has been found that many cosmetic compositions, including in particular solid antiperspirant or deodorant compositions do not adhere particularly strongly to a simple plain surface of the platform, which is typically made from a thermoplastic, so that subsequently, many inventors have sought to modify the platform shape to assist the composition to key with the platform. Adaptations to the platform have included a flanged tower extending above the main upper surface of the platform, as in U.S. Pat. No. 4,915,528 and U.S. Pat. No. 6,960,208, but that is not liked by users because of its shape. A tower, with or without flanges tends to dig into the skin to a much greater extent than does a flat or domed platform upper surface and is accordingly uncomfortable. Accordingly, it is considered preferable to employ a skeletal platform, but that has the disadvantage of having to be deeper than a simple plate, so that the length of the barrel has to be increased to accommodate it. It would be beneficial to identify a means of reducing the depth of the skeletal platform whilst at least maintaining previously enjoyed extent of adherence of the stick material to the platform during use.

The stick material is subjected in use to lateral forces and in advancement or retraction to longitudinal forces. The design of the platform needs to take both sets of forces into account. Moreover, it has become generally recognised that the world needs to conserve its resources better, so that a new design should strive to meet the objective of maintaining adherence whilst reducing the amount of construction material to make the platform. However, the inventors have further realised that less platform material could equate to thinner elements in a skeletal platform, but thinness increases the risk of flexing, and flexing results in creating fault lines at the junction of stick material and platform element. Thus, although the problem may be easy to state, the solution is not easy to obtain.

A further problem associated especially with bottom filling of stick dispensers, which commonly occurs under gravity or at a low pump pressure, is how to control the flow so as to ensure even filling, avoid air pockets and wasteful internal splashing and disruption to the flow as a result particularly of the material encountering the mounting for the spindle and/or particularly elements within the platform en route to the body of the barrel. Such needs complicate any solution to maintaining stick adherence and/or reducing the use of resources.

A skeletal platform means that the lower surface of stick can lose some of the carrier liquid that has been gelled to form the solid stick. Such drying out of the stick material often weakens the adherence of the material to the platform so that one or more seals are incorporated at the mounting of the wheel at the base of the barrel and of course the aperture in the wheel is normally plugged. However, seals typically bridge parallel surfaces of the elements forming the mounting of wheel at the base, and this likewise introduces dead space in the barrel. The inventors have recognised that it would be desirable to identify means to reduce the dead space without sacrificing the adherence of the stick material to the platform.

It would be inherently desirable to devise a platform that is capable of exhibiting reduced retention of stick composition therewithin when the platform reaches the open end of the barrel.

Commonly the rotor wheel and the spindle are moulded integrally. Whilst this reduces the number of separate mouldings, it means that the platform must be assembled after the combined wheel and spindle have been assembled into the dispenser barrel. Especially if a full base rotor wheel is employed, this is a relatively slow process.

Whilst it would be desirable to find an alternative process that was faster, it needs to retain the capability of the spindle to remain fixed to the rotor wheel whilst perform conventional advancement and retraction of the platform, and must continue to permit bottom fill of the dispenser through the rotor wheel.

In Kokai JP2008206723, published on 11 Sep. 2008, there is disclosed a separately moulded spindle and rotor wheel that is suitable for a top fill dispenser employing a solid platform and an associated assembly process in which the platform is inserted into the dispenser barrel, the spindle is then forced through a central aperture in the barrel until it encounters attachment means located in the rotor wheel. This arrangement suffers from a number of significant defects. First, because the platform is inserted by itself into the barrel, there is a significant risk that if it is allowed to drop into the barrel, it will not drop flat, or may stick. That substantially slows the assembly operation because it must be rectified. Secondly, the means for securing the spindle to the rotor wheel has to have a narrower diameter than the aperture in the platform for the threaded spindle, so that there is a risk of insecure attachment. A separate means must be provided to seek to overcome rotation of the spindle relative to the rotor wheel, namely a cog that has to mate with a hollow toothed cylindrical retaining boss wall of the rotor wheel. The rotor wheel is remote from the open end of the barrel through which the spindle must be inserted and the spindle is thin and comparatively flexible. Consequently that is a substantial practical disadvantage that the spindle tip will not engage the aperture in the rotor wheel squarely, hitting the edge and thus hindering or even halting the assembly process. Moreover, the cog needs to engage the toothed cylindrical boss exactly, otherwise it will not engage. That requires extremely precise assembly that is rendered very difficult by the remoteness of the spindle tip from the open end of the barrel. In short, this is a theoretical concept that is impractical to operate. However, there is a still further weakness in this proposed dispenser, namely that, the respective screw threads on the spindle and the threaded aperture in the platform must be sufficiently flexible and spaced apart to permit the spindle to be pushed through. This inevitably reduces the extent of engagement between the respective threads, increasing the risk of disengagement during conventional advancement and retraction operations. Whilst that is always a risk for a solid platform and a top fill dispenser, the risk would be increased if a skeletal platform were substituted, because the hub of the platform would have significantly reduced lateral support.

Other and further problems associated with bottom fill stick dispensers relate to the dead space in between the base of the barrel and the platform. Such space contributes to the weight of the package and in particular the weight of plastic needed to make the dispenser.

It is an object of the present invention to at least alleviate one or more of the disadvantages or problems with bottom-fill dispensers identified hereinabove.

Other and further objects of the invention may become apparent during the following discussion of the invention.

BRIEF SUMMARY OF THE PRESENT INVENTION

According to one aspect of the present invention, there is provided a dispenser for a composition in stick form comprising:

an oval barrel having an open end, a base remote from the open end and a sidewall that extends from the open end to the base and defines an interior of constant cross section;

a skeletal platform positioned within the barrel intermediate between the open end and the base and having an exterior rim wall fitting within the interior of the sidewall, a centrally located hub having an interior face bearing a screw-thread and defining an aperture, and a plurality of spokes between the rim and the hub, said spokes, rim and hub defining a plurality of passages;

means for advancing the platform towards the open end comprising a screw threaded spindle that extends through the base, is dimensioned to engage the screw-thread in the hub, and is mounted on a rotor wheel that itself is mounted on the base, the rotor wheel defining an aperture in fluid communication with at least one passage in the skeletal platform;

and optionally a former fitting within the open end and/or a cap fitting over the open end, the improvement in which the spindle is moulded separately from the rotor wheel, the spindle moulding comprises a longitudinal threaded rod and at least two lateral struts at one end, each strut being adapted to fit a mounting in the rotor wheel, and the rotor wheel comprises a central hollow boss having on its inner surface the mountings adapted to receive and hold the spindle strut.

By separately moulding the spindle and the rotor wheel and providing such an arrangement for assembling the two parts, it is possible to not only speed up the manufacture process, but also create a part that remains fit for its intended purpose whilst continuing to allow easy flow of stick material through the rotor wheel and into the body of the dispenser.

Herein, the term longitudinal is orthogonal to the base and lateral is orthogonal to the longitudinal. Upward refers to towards the open end of the barrel and likewise in respect of any components fitted within or on the barrel. The oval dispenser has major and minor lateral axes, as does likewise the platform fitting within the barrel and a rotor wheel matching in view the base of the dispenser. "Inward" is towards the hub, and "outward" away from the hub, so that with regard to the filling ring inward is between it and the hub and outward is between it and the rim.

In a related second aspect of the present invention, there is provided an assembly method for a dispenser according to the first aspect in which:

in separate and parallel or sequential operations, (i) the platform is threaded onto the spindle and wound to the bottom of the spindle, and (ii) the rotor wheel is mounted at the base of the dispenser barrel, (iii) the platform is assembled into the barrel and mounted into its mounting in the rotor wheel, (iv) the opposed open end of the barrel is closed by a puck or former, (v) the dispenser is oriented to the rotor wheel the wheel being above the closed open end, (vi) Stick material is charged into the dispenser through the rotor wheel until the platform is at least substantially full, (vii) the dispenser is cooled or allowed to cool until the stick material has solidified, whereupon, if desired the dispenser can be inverted and (viii) the puck, if employed, is removed, and (ix) optionally a cap is fitted over the open end.

The invention process not only enables the spindle to be made separately from the rotor wheel, but also by virtue of the platform being pre-assembled with the spindle before assembly with the rotor wheel, the location of the platform at the bottom end of the spindle stabilises the spindle during insertion into the barrel and locates the spindle centrally so that the mounting operation can be carried out precisely.

DESCRIPTION OF PREFERRED EMBODIMENTS

The present invention relates to a dispenser suitable for bottom fill through the rotor wheel and especially through a central filling zone in the platform.

In the present invention, the spindle is separately moulded from the rotor wheel and the spindle with its integral lateral strut is attached subsequently to the interior of the boss, into mountings, which advantageously can be snap-fit mountings. Such snap-fit mountings can comprise the outward ends of the lateral strut bearing at each end an upstanding lug that is radially inwardly elastically deformable. The lug preferably is inclined outwardly acutely to a longitudinal axis, for example at an angle of from 20 to 30 degrees. The lug at its outward edge preferably defines a snap fitting (such as a groove) to engage a corresponding mating fitting on the interior of the mount within the boss. Each lug is resiliently biased outwardly. Each lug is dimensioned to fit within a longitudinal channel providing a downward and inward-facing cam surface ending at its base in a base-plate constituting a stop wall and moulded into the interior face of the wheel boss. By modifying the lug to provide outward pressure on the boss or by affixing adhesive between contiguous faces, alternative mounting means can be provided.

In operation, the strut is slid down the channel over its cam surface, with slight distortion of the collar, until it clicks into place and is held by the outward bias of the lugs. The channel can advantageously be formed by a pair of integrally moulded longitudinal sidewalls (ribs), extending inwardly, preferably parallel, especially triangular with upward facing apex, and most desirably the ribs terminate at their lower end in a stop plate spanning them. To reduce plastic usage, the stop plate may leave a gap between it and the boss wall from which the ribs extend. Such a mounting is particularly beneficial in that it provides a secure means to prevent rotation of the spindle relative the boss, whilst at the same time offering little resistance to the ingress of stick material during the filling operation.

Advantageously, the mounting for the spindle is located inside the boss, and particularly is proximate to the lower end of the boss. In that context, the boss may be differentiated from a skirt, sometimes herein alternatively called a filling chimney, depending from the base of the boss that acts as a filling guide, in that the skirt may have a thinner wall, whereas the boss has a thicker wall, typically, in order to provide a suitably strong support for the spindle mounting and further to reduce or minimise flexing in the context of providing a seal at the base of the dispenser. The boss wall desirably has the same or similar thickness to that of the bottom edge of the filling ring at its top edge, but may have a reduced thickness below, such as a reduction of from 25 to 50% of the top edge thickness. By recessing the mounting for the spindle deep within the boss, it is possible to further reduce the dead space in a bottom filled dispenser and thereby shorten its exterior wall, saving plastic and weight. Moreover, by mounting the spindle at or proximate to the bottom of the boss, it is possible to extend the length of the hub below the rim of the platform, thereby maximising engagement between the treads on spindle and hub and minimising the risk of slippage without creating any dead space within the barrel. However, as a result of the spindle being mounted at or proximate to the base of the boss, it is preferable for the spindle to be moulded separately from the rotor wheel with which the boss is integral. Separate moulding offers processing benefits, each part being easily moulded, whereas the combined shape would be more difficult and slower, and indeed more difficult than if the spindle were mounted at the top edge of the boss as is conventional.

Advantageously, a shelf is integrally moulded at the base of the spindle having dimensions matched with the hub wall of the platform. Desirably, the upper face of the shelf provides the complementary saw tooth profile whose function has been described above.

Separate moulding furthermore permits a different assembly sequence from that which is conventionally adopted for bottom-fill dispensers. In the new sequence, the platform is first assembled with the spindle, the latter being retracted down the spindle as far as possible. In advantageous embodiments, that state is attained when each downward stop wall of the saw teeth at the base of the platform hub encounter the corresponding upward stop wall of the saw teeth the integrally moulded at the base of the spindle. In our case the spindle cross wall holding the lugs acts as the stop wall for the platform home position. Then, the assembled spindle and platform is then slid down the barrel until cross strut at the base of the spindle encounters and snap fits into the its mountings in the boss.

Advantageously, engagement of the saw teeth around the base of the spindle with those on the hub accordingly act as alignment means to align the struts of the spindle with the inward spokes within the platform attaching the filling ring to the hub, thereby guaranteeing a smooth ingress of molten stick material into the interior of the barrel. This has an added benefit of minimising filling times. Thereafter, the dispenser can be filled through its base as in the conventional sequence.

Whilst it is especially advantageous for the strut ends to snap fit into their dimensionally suitable recesses in the boss wall (or vice versa), a bead on the boss wall to snap fit into a recess moulded into the strut end, thereby providing a positive lock, alternative retention means can be provided to enable both propel and repel operations to be performed, i.e. advancing and retracting the platform. Such means can comprise affixing adhesive to the strut immediately or shortly prior to its insertion into the barrel and/or interference engagement. The latter is assisted in certain embodiments by employing outwardly biased resilient tabs or lugs that extend above or below the strut and after insertion into the mounting moulded into the boss provide radially outward pressure.

In a number of highly desirable embodiments, the dispenser comprises a platform having a central threaded hub and disposed around the hub a multiplicity of walls, preferably concentric which in practice is at the centre of the hub or having a focal point for intermediate walls that is within the filling ring. The outermost wall or rim is oval. In this specification, oval indicates non-circular, having a major and minor axis, preferably symmetrical. Situate between the rim wall and the hub are at least two and preferably three elliptical walls. Herein elliptical contemplates a varied or a constant radius, preferably constant which is often referred to as circular. The innermost wall defines the filling ring, and advantageously is circular. The rib or ribs intermediate between the filling ring and the rim wall span the rim. The rib or ribs could comprise a chord, or a chevron, but advantageously are arcuate to increase the wall length compared with a straight wall. Arcuate walls may be circular or preferably elliptical, the latter often subtending an arc of between 180 and 300 degrees, in total. The channel between the ring and the adjacent intermediate wall is advantageously of similar radial width along its length, preferably differing by no more that 20% and, particularly, no more than 10%. The same applies likewise to the channel between adjacent intermediate circular or elliptical walls. The channels desirably have the same or a similar radial width, within 20% of the narrower. By virtue of the oval shape of the rim wall, the channel between that and the outer intermediate wall can often have a varying radial width, widest along the major axis.

The oval platform most desirably exhibits mirror symmetry and the space between the filling ring and the rim can on either side of the minor axis forms a segment. In each segment, the intermediate wall or walls is or are preferably elliptical, spanning the rim, and for the purpose of calculating the extent of the arc subtended, half of the ellipse. Desirably, each half subtends between 90 and 150 degrees. Preferably, there are two intermediate arcuate walls between the filling ring and the rim wall.

The oval platform enables its manufacturer to choose whether or not the filling ring contacts the rim ring across the minor axis of the platform or is always spaced from the rim wall. Advantageously, in order to balance the demands of smooth bottom filling of the dispenser, weight of platform material and adherence of stick material to platform, the filling ring has an interior diameter that is at least ⅔rds of the rim diameter measured along the minor axis. It is desirable for said interior diameter to be up to ⅘ths of the rim diameter.

The filling ring is attached to the rim wall by at least one pair of opposed outward spokes extending radially, and preferably by two pairs. The two pairs are desirably orthogonal to each other and most desirably extend along the major and minor axes of the platform. It will be recognised that these outward spokes within the segments, and especially spokes along the major axis or inclined at less than 45 degrees to it, intersect the intermediate wall or walls. By providing such intersections, ideally at an angle between 85 and 95 degrees, rigidity is introduced into the structure, reducing or minimising flexing in use and therefore reducing the likelihood of the stick material separating from the platform by fracturing. This has the benefit of enabling relatively thin walls to be employed whilst retaining rigidity. In practice, the platform is made from moulded thermoplastics material such as polyethylene or polypropylene.

The presence of comparatively thin walls, but not excessively thin walls, has a number of significant benefits when combined with the intersecting spokes. First, this assists in providing a plurality of intermediate walls rather than single one for the same weight of platform material; the more walls, the greater the surface area of contact between the platform and the stick material and therefore, if contact can be achieved, the better the adhesion of the stick to the platform when subjected to longitudinal stresses. Adjacent thin walls leave more space between them than thick walls, but if less than enough space is left between adjacent walls, the stick cannot flow into it properly, thereby failing to create the desired wall/stick contact area. Since in practice, the outer dimension of a stick is constrained, and the number of walls along for example the major axis could be 6, excluding the rim, the overall gain can be significant.

However, the lateral forces acting on the stick material are also of considerable importance in practical use of the stick. By the use of the present design, it is possible to maintain a similar surface area for longitudinal forces whilst decreasing the depth of the platform. By so doing, the lateral force is spread across a longer length of walls reducing the stress per unit length of wall, and minimising the risk of severing stick material from the platform. Advantageously, the platform satisfies a ratio of total wall length (excluding the hub):depth in the range of at least 33:1, particularly at least 36:1 and especially at least 40:1. In many desirable embodiments, the ratio is up to 50:1, and good results have been obtained at up to 45:1. A platform meeting such a criterion enables a suitable spacing between walls to allow ingress of stick material whilst optimising wall length coupled with rigidity.

Advantageously, the platform according to the present invention has a contact surface area that is at least 60% of the lateral cross section area at its top (upper surface), often at least 65% and in particularly desirable embodiments, at least 70%. Commonly, the contact surface area is less than 100%, and in many embodiments is not greater than 85% of the top lateral cross section area. Said contact surface area is the total area of the platform measured within the rim and excluding the interior screw-threaded face of the hub. Accordingly, the present design offers improved adhesion between the stick material and the platform.

A platform meeting such a criterion enables a suitable spacing between walls to allow ingress of stick material whilst optimising wall length coupled with rigidity. Secondly, a thinner wall employs less plastic than a thicker wall. Thus, the same area of contact can be achieved using less plastic, which is inherently desirable or alternatively a greater area of contact can be achieved using the same weight of plastic, but with more walls having the same depth. Expressed differently, the same area of contact can be achieved by providing a greater wall length for contact, but with a shorter depth. This has the benefit of permitting a shorter barrel to be filled with the same volume of material, on account of needing to accommodate only the shorter platform.

Both of those two possibilities mean amongst other advantages that the weight ratio of dispenser to stick material can be reduced, reducing transport costs, and the concomitant $CO_2$ emissions.

The platform of the present invention particularly suitably has a lateral cross section of from 7 to 13.5 $cm^2$ and particularly from 8 to 12 $cm^2$. When the platform is oval, the ratio of major to minor axes is desirably in the range of from 5:3 to 2:1, and particularly together with either platform cross section range above.

If desired, the top of the skeletal platform can be flat. Alternatively, the top of the skeleton can be domed, for example the highest point of the skeleton, which may be the filling ring or the top of the hub, i.e. in the vicinity of the centre of the platform, being 1 to 3 mm higher than the top of the rim wall (which typically is flat around its circumference.

Desirably, at least one of the intermediate elliptical walls (ribs) has the same depth as the rim wall. By the employment of the design of platform of the instant invention, in advantageous embodiments, the ratio of the average length of the major and minor axis of an oval skeletal platform to the depth of the rim can be increased to above 9:2, such up to 6:1, for example around 5:1. By way of comparison, such a ratio in a conventional current apertured platform for bottom fill is commonly 4:1 or lower. This benefit can be achieved by a design as described above, by virtue of the platform having a smaller depth.

If desired, where there are two intermediate arcuate walls, one of them may have the same depth as the rim wall and the other can be shorter. Preferably, if it is shorter, its upper edge is flush with the upper edge of the rim wall or slightly proud defining an approximate shallow dome.

The rim wall and intermediate walls, other than that of the filling ring, desirably have a constant axial width and extend longitudinally, which in this context is parallel to the longitudinally extending side of the barrel, i.e. are not tilted.

Desirably, the rim wall, intermediate wall or walls and filling ring are separated by channels of average radial width in the range of from 2.5 to 4 mm and particularly 2.75 to 3.5 mm. Such a separation is particularly advantageous, since it is wide enough to permit ingress of stick materials such as antiperspirant or deodorant stick formulations, but narrow enough to enable an oval platform of a size suitable to be held in the hand to accommodate three sets of channels between the sealing ring and the rim wall in each sector of the platform, thereby achieving the benefit of the increased contact area from such a large number of wall sides within the platform.

The rim wall and intermediate walls desirably have a thickness of from 0.8 to 1.25 mm and especially from 0.9 to 1.1 mm. It is preferable to avoid the upper edge of the rim and intermediate wall being too thin, so as to reduce or ideally eliminate the risk of an extremely thin edge inducing cracking. The intersecting spokes desirably have a thickness of from 0.9 to 1.5 mm. In preferred embodiments of the present invention, the width ratio of spokes:said walls and/or rim is from 1:1 to 1.2:1.

The filling ring is attached to the hub by at least one pair of opposed radial spokes extending longitudinally. Advantageously, although two pairs could be employed, one pair is superior, in that it divides the passage between the filling ring and the hub into two zones, each of which zones subtends 180 degrees, so that the material can be filled into a zone without encountering an obstruct centrally located spoke, which would be the case if there were a second pair of spokes. Consequently, filling is rendered easier. The preferred single pair of spokes preferably extends along the minor lateral axis of the platform. The spokes linking the filling ring to the hub, and where appropriate also to the rim wall desirably have a thickness of from 1.25 to 2.0 mm and especially from 1.35 to 1.7 mm. The ratio of thickness to the hub/filling ring spoke to the intermediate ring spoke is desirably in the range of from 1.3: to 1.7:1. Advantageously, the spoke spanning the annular space between the hub and the filling ring has an integral triangular strengthening projection extending beneath the base of its contact with the filling ring wall.

The filling ring advantageously is dimensioned to improve the flow of material into the dispenser. In the first way, the diameter of the filling ring and the diameter of the boss on the wheel are matched, that is to say the same or within 5%, or the boss can telescope into the filling ring. In some advantageous embodiments, the boss telescopes into or around a skirt dependent at the bottom of the filling ring. By so doing, and especially if the boss fits within or around a filling ring skirt, it is possible to align the two such that the material flows through the boss and the passage in the platform with minimal obstruction and minimal risk of turbulence being created that would deleteriously affect smooth flow. By so doing, it is possible to abut the upper surface of the boss with the lower surface of the filling ring further reducing the risk of impaired flow.

Secondly, the filling ring preferably has a wall with a different profile from that of the rim wall and intermediate walls. Preferably, its inner side, i.e. side facing the hub extends longitudinally, which can assist the flow of stick material. The outer face of the filling ring preferably tapers upwardly and inwardly, having a thicker base than top. Conveniently, the taper is chosen in the range of from 5:2 to 7:2, and especially around 3:1. Although the taper can be constant, in a further variation, the taper can terminate around halfway, the profile being stepped, and thereafter the upper fraction of the ring wall can be parallel sided. A tapered ring wall combines the benefit of a comparatively wide base for engagement with the top of the boss on the rotor wheel, as mentioned above with minimal amount of plastics material.

In especially desirable and practical embodiments, the base of the filling ring and the top of the wheel boss each define complementary saw tooth cam profiles, preferably at least 2 teeth symmetrically disposed, more preferably at least 3 teeth, such as up to 6 teeth, and especially 4 teeth. The profile on the base of the filling ring includes an inverted well defining a stop wall that engages a sharply inclined or upright edge of the corresponding tooth on the top of the wheel boss. When the wheel is rotated to retract the platform, the platform is drawn towards the boss, and the leading sharp edge enters an inverted well until it encounters the sharp, upright edge of the corresponding tooth at the base of the filling ring. The rotation is accordingly halted. This renders it less likely that the rotor wheel would be over-rotated and thus broken because the sudden engagement offers a significant signal to the average user to stop turning. The filling ring and boss provide a superior location for the toothed cam system providing a warning to users, guarding against over-rotation. Hitherto, cooperating lugs have been provided on a flange at the base of the spindle engaging the hub. Whilst in theory, it offers the same concept, in practice the cooperating lugs are much closer to the centre of the wheel and therefore the torque that can be exerted is much less than by creating a filling ring that is dimensioned to accommodate the stop system contemplated herein. Advantageously, the system herein employing the filling ring can readily generate a torque of at least 1.5 NM, eg up to 2 NM, compared with a previous spindle-based system that generates a torque of less than 1 NM.

It is particularly desirable to for the filling ring and wheel boss to comprise the complementary toothed cam/stop system to warn users not to continue seeking to retract the platform when the lateral cross section of the rotor wheel matches that of the base of the barrel, because the user can exert much greater leverage from the oval rotor wheel than a small central (thumb) wheel.

The upper fraction of the filling ring wall preferably is parallel sided, such as in the upper $\frac{1}{5}^{th}$ up to upper $\frac{1}{3}^{rd}$. By so doing, both faces of the ring wall at its line of contact with the bulk of the stick material extend longitudinally rather than being inclined, thereby reducing the risk of shearing that can arise when the wall face is inclined.

Advantageously, the base of filling ring wall is recessed relative to the rim wall and preferably, at least one of the intermediate elliptical (arcuate) walls. Advantageously the recess constitutes from 15% to 50% and especially from 20% to 35% of the depth of the rim wall. Commonly, the boss is proud of the rotor wheel, so that this arrangement permits the platform to descend further down the barrel than if the base of the ring wall were flush with the base of the rim wall. In addition, by locating the mouth of the wheel boss within the platform, the risk is reduced of stick material being dissipated into the dead space below the platform during the filling operation even if there is less than ideal mating between the base of the filling ring and the top of the boss.

The central threaded hub desirably extends below the base of the rim wall and particularly has an overall length that is from 1.5 times to twice the depth of the rim wall. Such a relative arrangement provides adequate engagement between the spindle and platform threads to enable ready transfer from rotational movement of the rotor wheel to axial movement of the platform, whilst at the same time recognising the reduced depth of the platform walls. Advantageously, the base of the hub also has a saw-tooth base profile, but because the hub has a smaller diameter than the filling ring, desirably comprises two symmetrically positioned teeth and stop walls rather than 4. Such teeth assist in the assembly process, maintaining alignment of the platform with the wheel boss, but are sometimes not sufficient to provide the desired extent of force to signal when a strong user should stop retracting the platform. Accordingly, it is desirable for the cam/stop system on the filling ring/boss as described above to be employed in addition to the cam/stop system on the hub/spindle. They can perform different functions during assembly and operation of the dispenser.

The dispenser barrel has a base wall desirably having a co-axial central longitudinally-extending upstanding cylindrical collar having an internal diameter slightly less than the external diameter of the filling ring. By slightly in this context is meant a diameter that is often from 0.3 mm to 1 mm less. The collar provides a sealing surface that engages with the upstanding boss to minimise air ingress and/or volatile material egress from the dispenser.

The means to advance or retract the platform comprises the rotor wheel on which the threaded spindle is mounted or integrally formed, desirably extending upwardly from the centre of a cross-strut or pair of orthogonal cross struts. Especially desirably, the spindle is mounted on a single cross strut. Most desirably, the single cross strut for the spindle mounting is aligned with a single cross spoke that links the platform hub and filling ring. Such alignment optimises the passage for stick material through the rotor wheel and platform into the barrel, enabling in-fill on one side of the spoke and air expulsion on the other with minimal interference from any baffle.

The base of the barrel preferably comprises a base plate on which a cylindrical collar defining a circular aperture that is a dimensioned to accommodate co-axially the boss of the rotor wheel is integrally moulded centrally. Conveniently, the collar may extend completely or partly above the base wall inside the barrel, in conjunction with a boss that is at least partly proud of the top of the rotor wheel. At the other extreme, the collar may depend from the base of the barrel together with the boss being entirely located within the rotor wheel. When the boss is mounted at least partly within the rotor wheel, a wall of sufficient strength to bear the boss depends from the top wall of the rotor wheel and defines with the outer face of the boss an annular chamber that accommodates the collar.

The rotor wheel advantageously comprises a co-axial upstanding centrally located longitudinally extending hollow boss. Conveniently, the boss is snap-fitted into the collar by conventional snap-fit elements, permitting rotation of the boss relative to the collar. Particularly desirably, the boss has an exterior diameter that is very slightly less than the interior diameter of the collar creating a narrow annular gap that is bridged by at least one and preferably at least two radially extending unbroken narrow flexible fins. The fin or fins can desirably extend radially, or if the boss comprises a radial flange section, at least one of them can extend axially between opposed faces of the boss flange and the barrel base, in addition to or instead of between axially extending section of the boss and the collar. Conveniently, that gap between boss and collar and/or barrel base can be radially or axially (as the case may be) from 0.3 to 1 mm and often from 0.4 to 0.6 mm. The fins are conveniently integrally moulded with the boss.

The rotor wheel for an oval barrel can be either a full base rotor wheel having a similar external cross section to that at the base of the barrel, or a smaller wheel, preferably knurled, and commonly having an exterior diameter that is similar to that at the minor lateral axis of the barrel and partly hidden by a skirt depending below the barrel base and having two opposed windows through which the arc of the wheel protrudes.

The dispenser contemplated and described herein comprises a plurality of features that either alone or together with one or more other features described herein differentiate the dispenser from other dispensers that are currently marketed. These features include:—

The design of the skeleton platform, including one or more of the adoption of a filling ring spaced from the rim by spokes, and/or the disposition of intermediate walls between the rim and the platform hub that increases the length of wall at the top of the platform relative to surface area of contact between the stick material and the interior of the platform, optionally assessed by the depth of its rim; the design of the filling ring, including one or more of:— recessing its bottom edge within the platform, shaping its bottom edge to provide a cam/stop profile in association with a complementary cam/stop profile on the top edge of the boss;

the filling ring tapering inwards from its bottom edge to a point intermediate between its bottom and top edges and an upper section with parallel sides;

A rotor wheel having a hollow boss and one or more of the features in which the spindle is mounted proximate to the base of the boss and/or the spindle is mounted along one axis only, the axis being the same as the mounting of the filling ring in the platform, and/or the spindle is moulded separately from the remainder of the rotor wheel and snap fits into a mounting integrally moulded on the interior face of the boss and/or the boss has a frusto-conical lower section and a cylindrical upper section;

A filling ring and boss dimensioned for the boss to telescope into the filling ring or the bottom edge of the former abut the top edge of the latter to provide a continuous enwalled passage for stick material to be charged into the interior of the barrel;

A barrel having a reduced length as a result of the platform having a filling ring recessed within the platform, and/or the platform having a reduced rim depth (advantageously whist maintaining the same contact surface are with embedded stick material), and/or the spindle being mounted within the boss proximate to its base and/or the barrel collar depending at least partly below the barrel base and the boss being sunk at least partly inside the rotor wheel.

Hereinabove, in relation to numerical data such as limits or boundaries or specific amounts, such data may be qualified by the term "approximately".

Having summarised and described the invention more particularly, specific embodiments thereof will now be described in more detail by way of illustration only with reference to the appended Figures.

Figure 1:
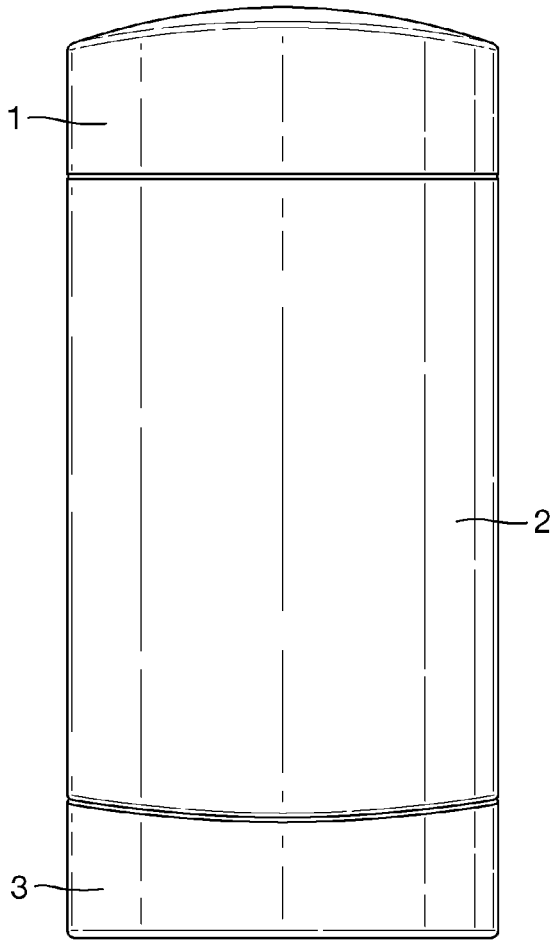
FIG. 1 represents a side elevation of a dispenser, viewed looking along its minor axis.
Figure 2:
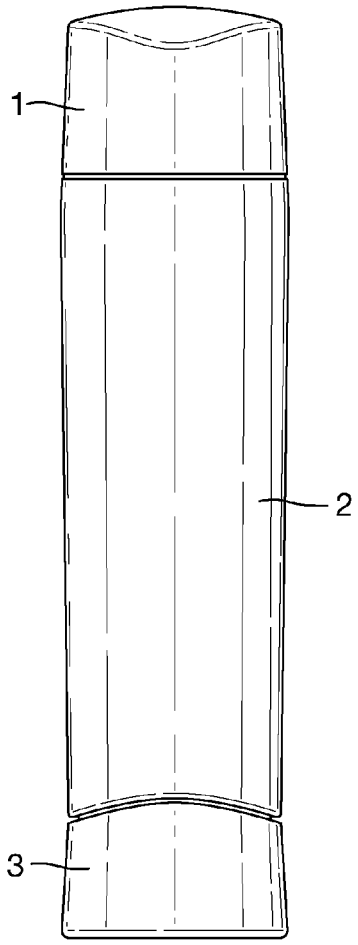
FIG. 2 represents a side elevation of the same dispenser, viewed looking along its major axis.
Figure 3:
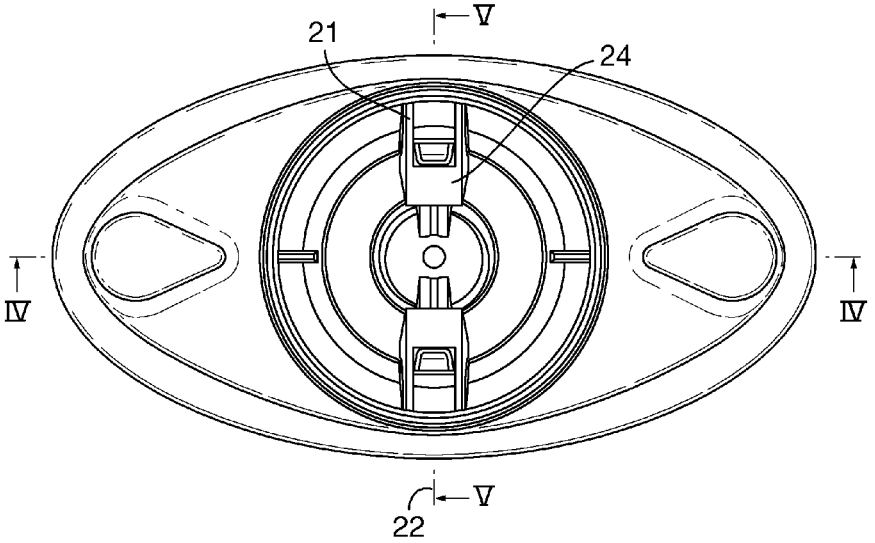
FIG. 3 represents a plan view from underneath of the dispenser of FIGS. 1 and 2.
Figure 4A:
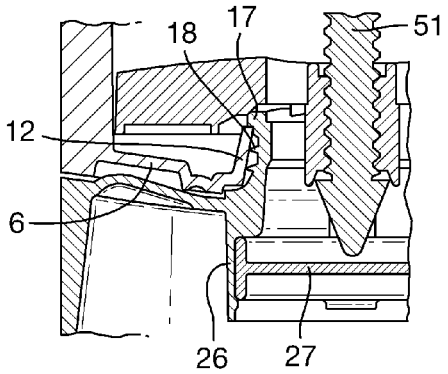
FIG. 4 represents a cross section of the dispenser of FIG. 1, viewed looking along its minor axis.
Figure 4B:
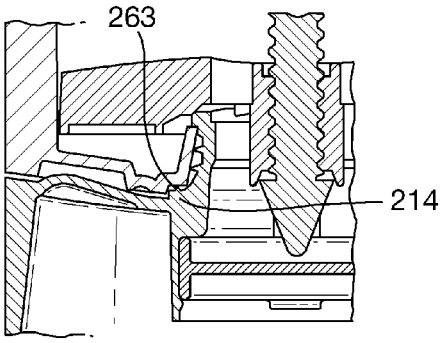
Figure 4:
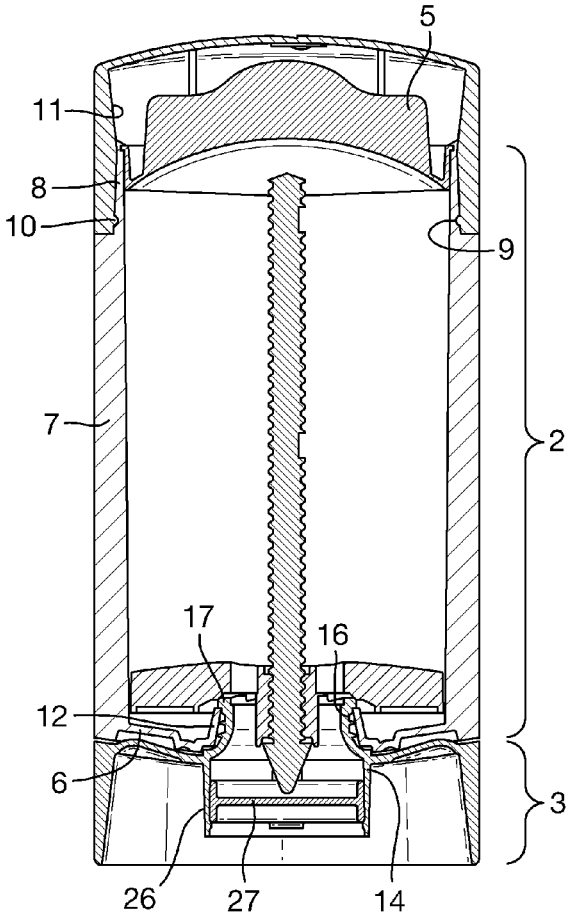
Figure 5:
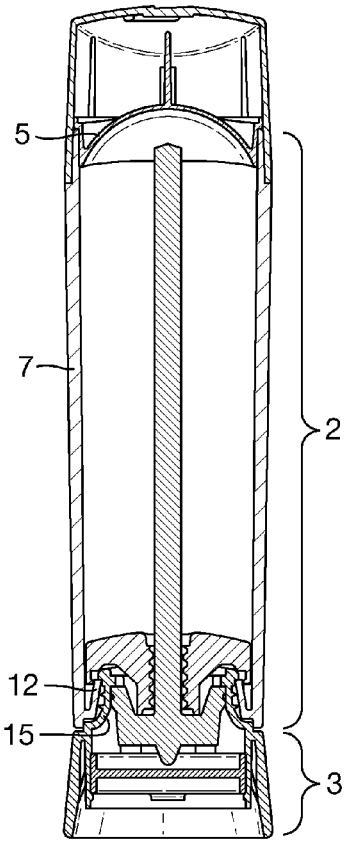
Figure 6:
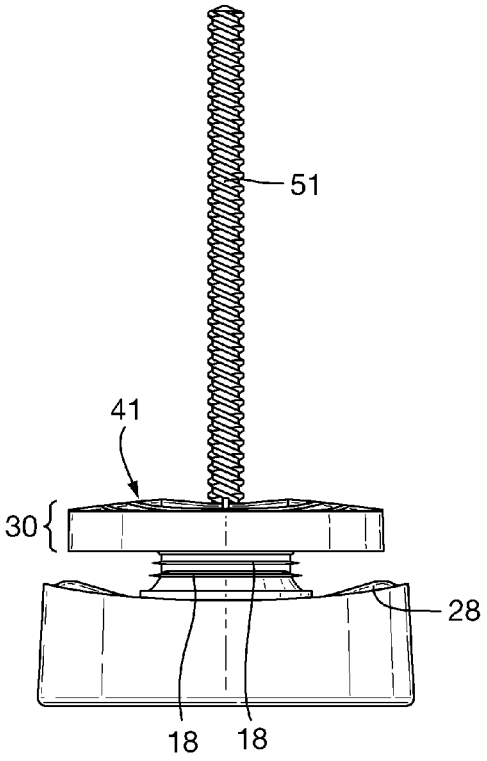
Figure 7:
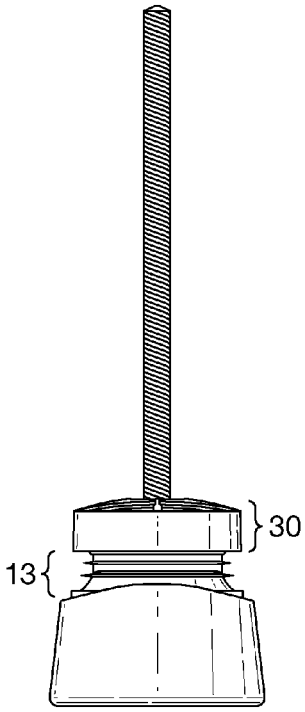
Figure 8:
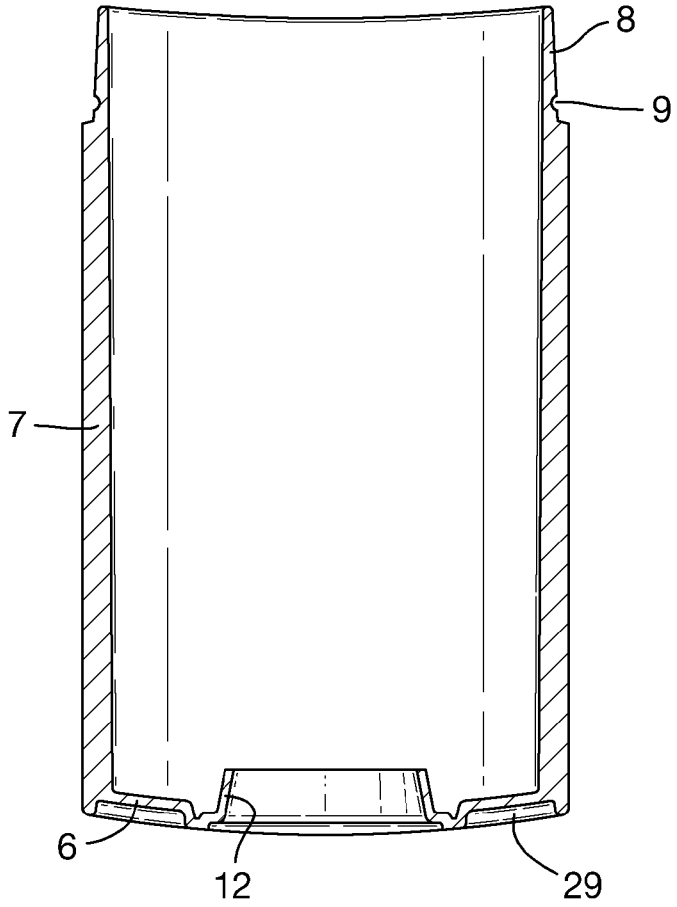
Figure 9:
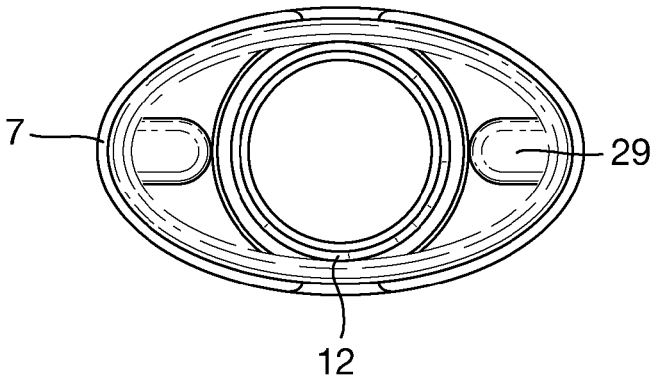
Figure 10:
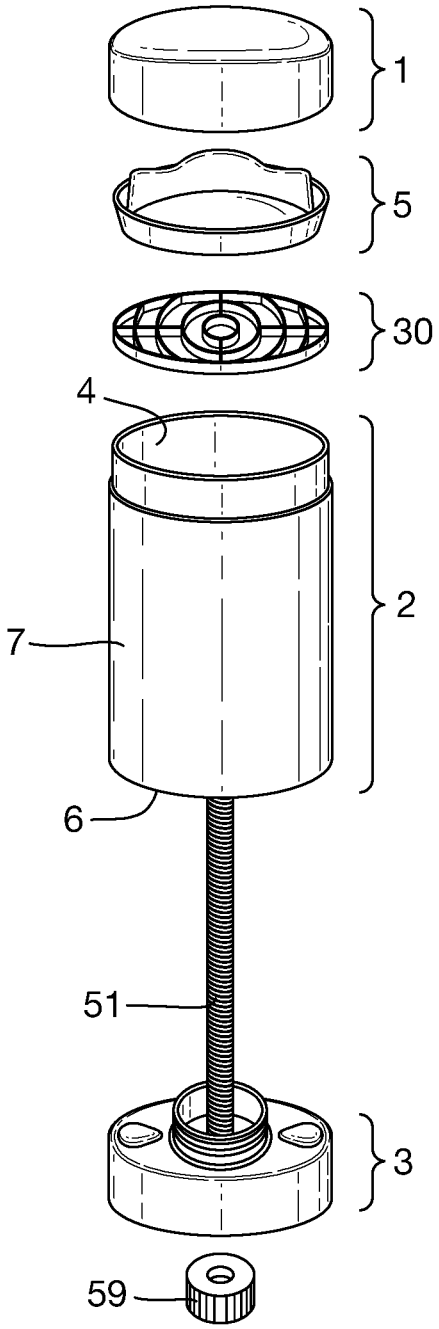
Figure 11:
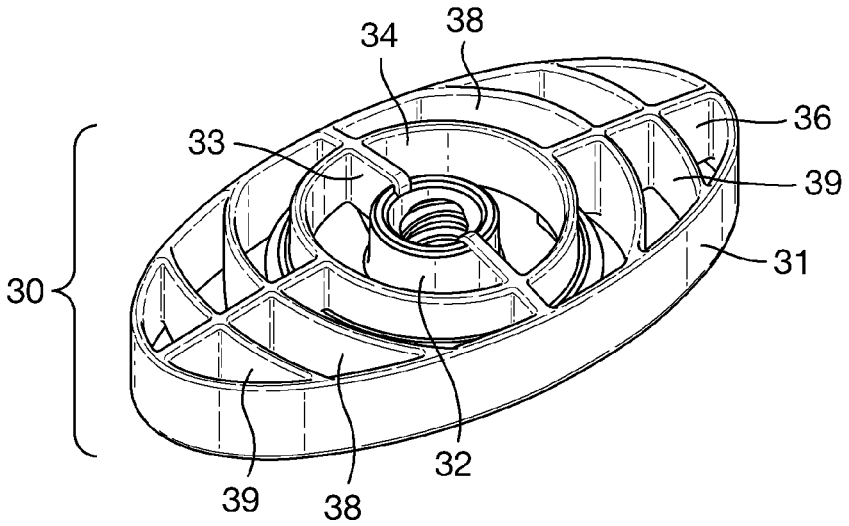
Figure 12:
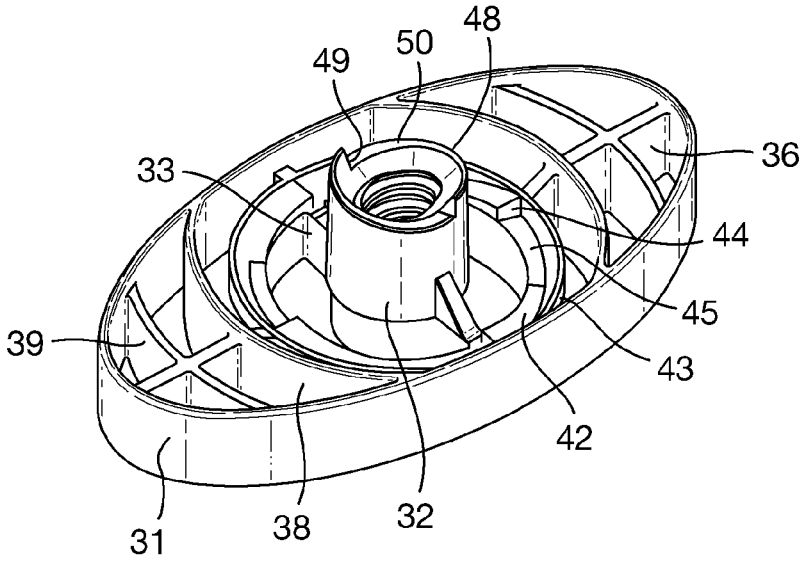
Figure 13:
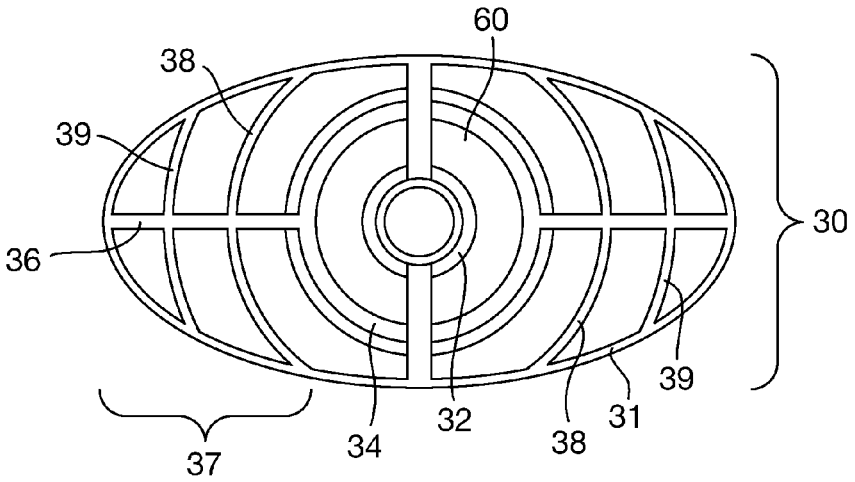
Figure 14:
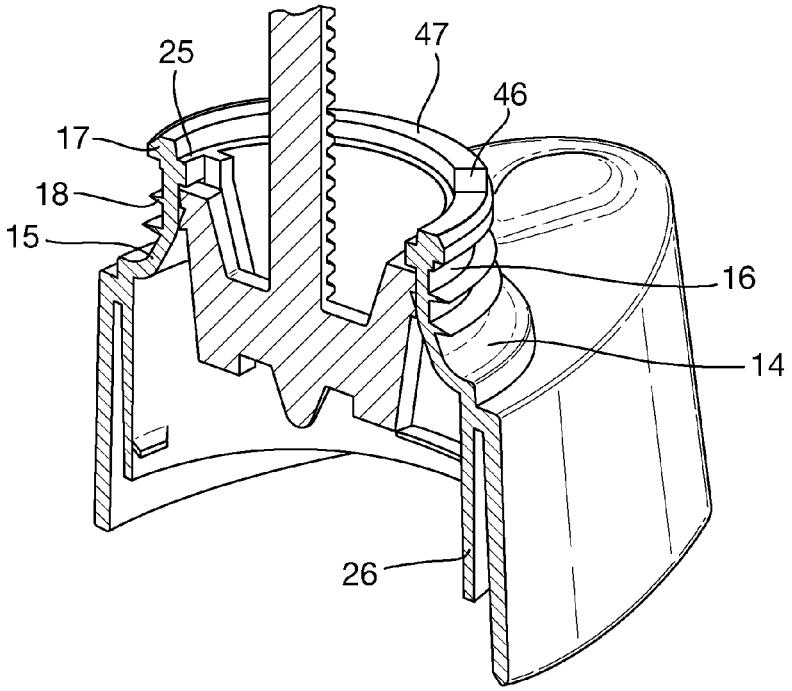
Figure 15:
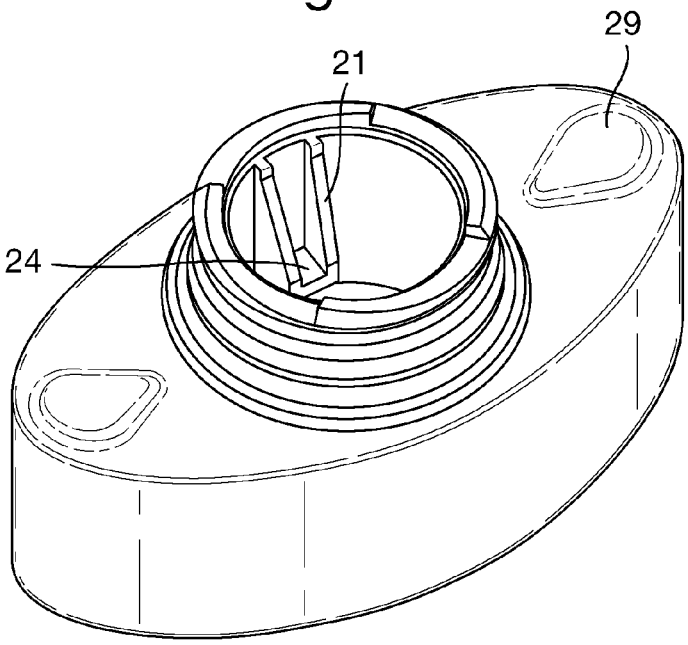
Figure 16:
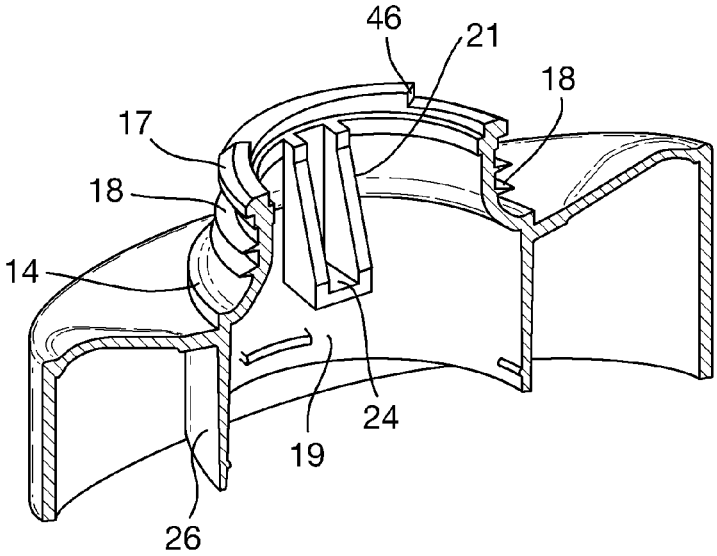
Figure 17:
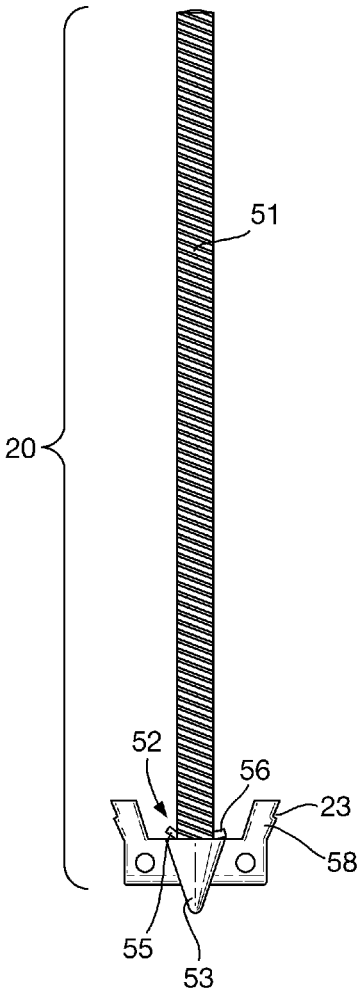
Figure 18:
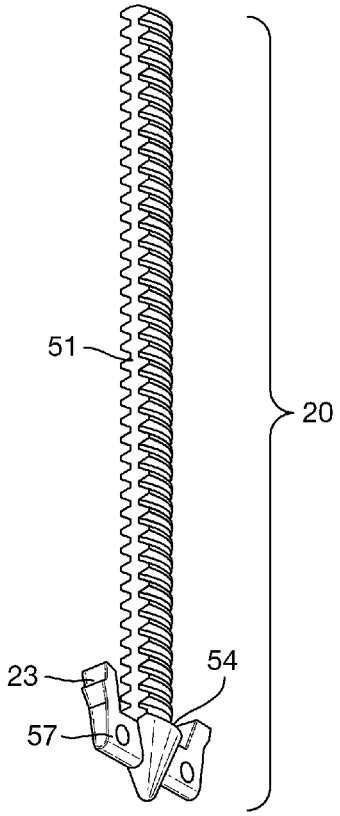

FIG. 4*a* represents an enlargement of part of the dispenser shown in FIG. 4, including sealing fins;

FIG. 4B represents a variation to the dispenser of FIG. 4 showing an alternative arrangement of sealing fins;

FIG. 5 represents a cross section of the dispenser of FIG. 2, viewed looking along its major axis;

FIG. 6 represents a side elevation of the rotor wheel, platform and spindle of the dispenser in FIG. 4;

FIG. 7 represents a side elevation of the rotor wheel, platform and spindle of the dispenser in FIG. 5;

FIG. 8 represents in cross section the barrel shown in FIG. 4;

FIG. 9 represents a plan view of the barrel shown in FIG. 4;

FIG. 10 represents an exploded view of the components of the dispenser of FIGS. 1 and 2;

FIG. 11 represents a ¾s elevation of the top of the platform shown in the dispenser of FIG. 10;

FIG. 12 represents a ¾s elevation of the bottom of the platform shown in the dispenser of FIG. 10;

FIG. 13 represents a plan view of the top of the platform shown in the dispenser of FIG. 10;

FIG. 14 represents a cross section of the rotor wheel with spindle mounted of FIG. 7, cut along the minor axis;

FIG. 15 represents a ¾s side elevation of the rotor wheel shown in the dispenser of FIG. 10;

FIG. 16 represents a cross section of the rotor wheel of FIG. 15, cut along the major axis;

FIGS. 17 and 18 represent side and ¾s side elevations of the spindle shown in the dispenser of FIG. 10.

Figure 19:
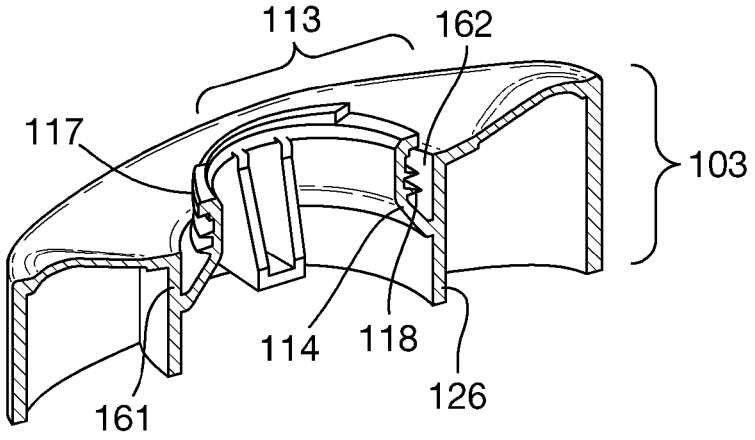
Figure 20:
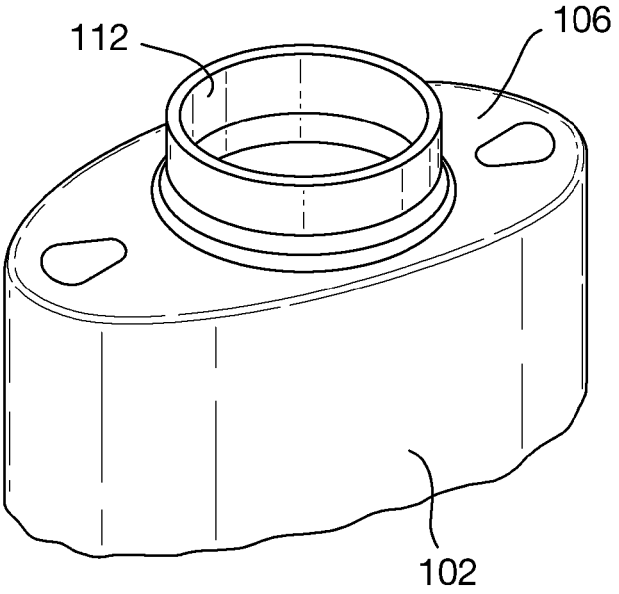

FIG. 19 represents a cross-section of a rotor wheel a second dispenser cut along its major axis, in which the boss is recessed inside;

FIG. 20 represents in ¾ elevation the inverted base section of a barrel for employment with the rotor wheel of FIG. 19.

The dispenser illustrated in FIGS. 1 to 18 comprises a cap (1) fitted at one end of a barrel (2) on which is mounted at its other end a rotor wheel (3). With reference in particular to FIGS. 4, 5, 8, 9 and 10, the barrel (2) comprises an open end (4) in which is fitted a former (5), a base (6) and a side wall (7) extending between the open end (4) and the base (6), and having a section of reduced wall thickness (8) proximate to the open end (4) with a groove (9) to snap fit with a corresponding bead (10) projecting inwards from the interior face (11) of the cap (1). An integrally moulded circular frusto-conical collar (12) projects upwardly and centrally from the barrel base (6).

With reference in particular to FIGS. 1 to 7, 10 and 14 to 16, the rotor wheel (3 is mounted at the base (6) of the barrel (2) by a hollow boss (13) dimensioned to snap fit with the collar (12), comprising an annular shelf (14) projecting outwardly proximate to the base of the boss (13), a boss sidewall comprising a frusto-conical lower section (15) and a cylindrical upper section (16)) extending upwardly through the collar (12) and terminating in a lip flange (17) that snaps over the upper edge of the collar (12). The boss (13) further comprises a pair of parallel outward-facing unbroken flexible blade-like sealing fins (18) that span the annular space between the inner face of the collar (12) and the outward face of the boss (13). On the interior face of the boss (13) is integrally moulded an opposed pair of mountings (19) for a screw-threaded spindle (20). Each mounting (19) comprises a pair of sidewalls (21) extending inwardly on either side of and parallel with the minor axis (22) of the rotor wheel (3), defining a slot to accommodate for a lug (58) defining a snap fit groove (23) integrally moulded with spindle (20), and a base plate (24) extending about 60% towards the interior face of the boss sidewall. An inward-extending snap-fitting lip (25) is moulded at the upper end of the slot. A cylindrical skirt (26) that is thinner than the boss wall (15, 16) depends from the base of boss (13), beneath the outward edge of shelf (14), having a lateral rib (27) that snap fits an interior wall of a closure cap (59) pushed upwardly into the skirt (26). The rotor wheel (3) further comprises a pair of upward facing opposed tear-shaped dimples (28) that can be rotated into a corresponding pair of recesses (29) in the base (6) of barrel (2).

With reference in particular to FIGS. 4 to 7 and 10 to 13, an integrally moulded skeletal oval platform (30) measuring 46 mm along its major axis and 25 mm along its minor axis comprises a rim (31), a central hub (32) having interior screw threading, a pair of opposed spokes (33) extending from the hub (32) to the rim (31) and intersecting a filling ring (34), a pair of opposed spokes (36) extending from filling ring (34) to the rim (31). The rim (31) and filling ring (34) define a pair of sectors (37) within each of which sector are inner and outer elliptical walls (38, 39) spanning the rim (31) and intersecting the spoke (36). Rim (31) and walls (38, 39) filling ring (34) at its upper edge have a thickness of about 1 mm (0.9-1.1 mm). The rim (31) has a depth of 7 mm. Elliptical wall (rib) (38) has a bottom edge parallel with the rim (31) bottom edge, and the bottom edge of elliptical wall (rib) (39) is recessed. The upper edge of the hub (32) is at the same height at the upper edge of the rim (31), and the upper edge of the filling ring (34), spokes (36) and intermediate elliptical walls (ribs) (38, 39) form a shallow dome shape (41). The illustrated platform has a ratio of its total wall length (measured along its upper edge and excluding the top edge of the hub) to rim depth of 42.7:1. The illustrated platform has a contact surface that is 75.3% of its top surface area (excluding its hub).

The filling ring (34) at its bottom edge (42) is recessed above the base edge of the rim (31) by about $\frac{1}{3}^{rd}$ the depth of the rim (31) (about 2.5 mm) and has a thickness at its top edge of about 1 mm (0.9 to 1.1 mm). The bottom edge (42) comprises a thin retaining rim (43) and a set of 4 saw teeth symmetrically located around the bottom edge (42), each tooth being formed from a stop wall (44) and an inclined surface (45). Each tooth matches a corresponding saw tooth moulded at the top edge of the boss (13) comprising a stop wall (46) and an inclined surface (47). The filling ring tapers inwardly and upwardly from bottom edge (42) about halfway and thereafter is parallel sided. The lip flange 17 of the boss (13) fits beneath the filling ring rim (43) and the thickness of teeth (46, 47) matches the thickness of teeth (44, 45) as does the angle of inclination of (47) to (45).

The hub (32) has a depth that is about 160% the depth of rim (31), extending below the rim and at its bottom edge (48) defines a pair of symmetrical saw teeth comprising a stop wall (49) and an inclined surface (50).

With regard particularly to FIGS. 17 and 18, the spindle (20) comprises a threaded shaft (51) integrally moulded at its lower end (52) with an inverted cone (53) defining an upward-facing shelf (54) formed with a pair of upstanding saw teeth formed from a stop wall (56) and an inclined surface (55) corresponding to saw teeth formed from stop wall (49) and inclined surface (50) at the bottom edge of the hub (32). A pair of opposed lateral struts (57) is moulded with the cone (53) and proximate to its exterior end, a lug (58) extends upwardly inclined at an angle of 25 degrees to the longitudinal axis. The outward edge of the lug (58) defines the lateral groove (23) that snap fits with the boss (13) within mounting (19). In an alternative embodiment, not shown, the spindle can be fabricated without the saw teeth, in which case the struts 57 act as stops.

The cap, barrel, former, rotor wheel, spindle and platform are moulded from a thermoplastic. The dispenser is assembled by coaxially positioning the spindle (20) above the boss (13) of the rotor wheel (3), aligning the struts (57) with the mounting slots defined by walls (21) and bringing them together until the struts (57) encounters base plate (24), whereupon the lip (25) snap fits over lug (58). That assembly is then co-axially positioned below the base (6) of barrel (2) and the boss (13) inserted into collar (12) until the two snap fit together. Next, the platform with hub extending downwards in the open end of the barrel (2) is brought into contact with the spindle shaft (51) to enable the screw threads in hub and shaft to engage and the rotor wheel (3) is rotated until the platform has been fully retracted. At that point the saw stop wall (44) engages boss stop wall (46) and rotation of the rotor wheel is halted. The former is inserted in the open end of the barrel, which is inverted for bottom filling through the aligned skirt, 26, boss (13) and semicircular passage (60) between hub (32) and filling ring (34). After the dispenser has been filled with stick material until it reaches the bottom of the rim (when in upright orientation), the dispenser is cooled until the stick material has solidified, the stop cap (59) is inserted in the rotor wheel skirt (26), the dispenser re-inverted to its upright orientation and the cap (1) fitted.

In a variation of dispenser shown in FIGS. 19 and 20, the platform, spindle and mounting of the spindle in the rotor wheel boss are the same as shown in FIGS. 1 to 18. The rotor wheel and base of the barrel differ and are as described below, adopting the same number sequence, but in the 100 series. The rotor wheel (103) comprises the elements described in relation to FIG. 16 except that the skirt depending from the top wall of the rotor wheel becomes a thickened cylindrical wall (161) below which is a shortened skirt (126). The boss (113) is integrally moulded with the cylindrical wall (161) via annular shelf (114). The cylindrical wall (161) defines with the outward face (117) of the boss (113) an annular slot (162) which, when the parts shown in FIGS. 19 and 20 are attached, accommodates the collar (112) that depends below the base (106) of the barrel (102), instead of extending upwardly within the barrel. Flexible fins (118) span between the outward face (117) of the boss (113) and the collar (112). The configuration shown in FIGS. 19 and 20 enable the barrel to be shortened even more than in the dispenser of FIGS. 1 to 18. In the dispenser variation shown in FIGS. 19 and 20, the platform shown in FIG. 13 can be configured such that the filling ring (34) at its base is flush with the bottom edge of the rim (31) instead of being recessed, thereby enabling edge to edge contact with the top edge of the boss (113).

In a second variation, as illustrated in FIG. 4B, the dispenser illustrated in FIGS. 1 to 18 is modified by employing an axially extending sealing flexible fin (263) moulded on the upper surface of boss flange (214).

The invention claimed is:

1. In a dispenser for a composition in stick form comprising:

an oval barrel having an open end, a base remote from the open end and a sidewall that extends from the open end to the base and defines an interior of constant cross section;

a skeletal platform positioned within the barrel intermediate between the open end and the base and having an exterior rim wall fitting within the interior of the sidewall, a centrally located hub having an interior face bearing a screw-thread and defining an aperture, and a plurality of spokes between the rim and the hub, said spokes, rim and hub defining a plurality of passages; and a screw threaded spindle for advancing the platform towards the open end, wherein the spindle extends through the base, is dimensioned to engage the screw-thread in the hub, and is mounted on a rotor wheel that itself is mounted on the base, the rotor wheel defining an aperture in fluid communication with at least one passage in the skeletal platform;

the improvement in which the spindle is moulded separately from the rotor wheel, the spindle comprises a longitudinal threaded rod and at least two lateral struts at one end, each strut being adapted to fit a mounting in the rotor wheel, and the rotor wheel comprises a central hollow boss having on its inner surface the mountings adapted to receive and hold the spindle strut.

2. A dispenser according to claim 1 in which the boss has a lower section defining a frusto-conical interior in which the lateral struts are mounted.

3. A dispenser according to claim 1 in which the boss includes a base and the mountings for the lateral struts of the spindle are located proximate to the base of the boss.

4. A dispenser according to claim 1 in which each mounting for the lateral strut of the spindle comprises a pair of parallel longitudinally extending sidewalls integrally moulded on the inner surface of the boss and bridged at their bottom edge by a lateral base plate.

5. A dispenser according to claim 4 in which the sidewalls are triangular having an upwardly pointed apex.

6. A dispenser according to claim 4 in which there is a gap between the lateral base plate and the interior face of the boss.

7. A dispenser according to claim 1 in which each lateral strut has an exterior end and proximate thereto a lug that snap fits into the matching mounting of the boss.

8. A dispenser according to claim 7 in which the lugs formed on the lateral struts extend longitudinally upwardly.

9. A dispenser according to claim 1 in which the spindle has only two opposed struts.

10. A dispenser according to claim 9 in which the mountings for the spindle struts are located in the boss along a minor axis of the dispenser.

11. A dispenser according to claim 1 in which the boss is part of an upper face of the rotor wheel and a collar at the base of the barrel extends at least partly inside the barrel.

12. A dispenser according to claim 1 in which the boss is accommodated inside the rotor wheel and a collar extends below the base of the barrel.

13. A method of assembling a dispenser for stick material in accordance with claim 1 in which:

in separate and parallel or sequential operations, (i) the platform is threaded onto the spindle and wound to the bottom of the spindle, and (ii) the rotor wheel is mounted at the base of the dispenser barrel, (iii) the platform is assembled into the barrel and mounted into its mounting in the rotor wheel, (iv) the opposed open end of the barrel is closed by a puck or former, (v) the dispenser is oriented to the rotor wheel the wheel being above the closed open end, (vi) stick material is charged into the dispenser through the rotor wheel until the platform is at least substantially full, (vii) the dispenser is cooled or allowed to cool until the stick material has solidified, whereupon, if desired the dispenser can be inverted and (viii) the puck, if employed, is removed.

* * * * *